United States Patent [19]

Togashi

[11] 4,245,697

[45] Jan. 20, 1981

[54] TUBULAR BODY

[76] Inventor: Akira Togashi, 14-31, 6-chome, Ryoke, Urawa-shi, Saitama-ken, Japan

[21] Appl. No.: 94,124

[22] Filed: Nov. 14, 1979

Related U.S. Application Data

[60] Continuation of Ser. No. 7,530, Jan. 29, 1979, abandoned, which is a division of Ser. No. 776,215, Mar. 10, 1977, abandoned.

[30] Foreign Application Priority Data

May 24, 1976 [JP] Japan ..... 51-59863

[51] Int. Cl.[3] ..... F28F 1/08

[52] U.S. Cl. ..... 165/179; 138/38; 138/42

[58] Field of Search ..... 138/38, 42, 122, 121; 165/133, 179, 184

[56] References Cited

U.S. PATENT DOCUMENTS

| | | | |
|---|---|---|---|
| 2,252,045 | 8/1941 | Spanner | 138/38 |
| 3,212,992 | 10/1965 | Salesse et al. | 138/42 |
| 3,217,799 | 11/1965 | Rodgers | 165/179 |
| 3,779,312 | 12/1973 | Withers, Jr. et al. | 165/184 |
| 3,875,997 | 4/1975 | Newson et al. | 165/179 |
| 3,907,028 | 9/1975 | Lawson | 138/38 |

FOREIGN PATENT DOCUMENTS

| | | | |
|---|---|---|---|
| 2043459 | 3/1972 | Fed. Rep. of Germany | 165/133 |
| 11612 | of 1899 | United Kingdom | 138/38 |

*Primary Examiner*—Sheldon Richter
*Attorney, Agent, or Firm*—James Creighton Wray

[57] ABSTRACT

A tubular body on whose external surface are formed a series of periodically wavy recesses of specific depth and angle, said recesses becoming the corresponding series of similarly wavy projections and thereby improving the mixed state or heat conduction efficiency of a fluid flowing therein.

23 Claims, 10 Drawing Figures

TUBULAR BODY

This application is a continuation of application Ser. No. 7,530, filed Jan. 29, 1979, now abandoned, which is a division of application Ser. No. 776,215, filed Mar. 10, 1977, now abandoned.

BACKGROUND OF THE INVENTION

The present invention relates to a tubular body which improves the mixed state or heat conduction efficiency of a fluid flowing therein.

It has been common practice to fabricate the heat conduction pipe of, say, a heat exchanger of a material with high heat conductivity or to provide said pipe with fins to increase the area of heat conduction, thereby improving the heat conduction effect. Such a practice has, however, been unable to produce a pipe meeting various requirements for increased efficiency of the heat exchanger.

Aimed at solution of this problem, the tubular body according to the present invention is characterized by being provided on the external surface with a series of periodically wavy recesses of specific depth and angle and accordingly on the internal surface provided with the corresponding series of similarly wavy projections.

SUMMARY OF THE INVENTION

The first object of the present invention is to provide a tubular body which improves the mixed state or heat conduction efficiency of a fluid flowing therein.

The second object of the present invention is to provide a tubular body characterized in that a fluid can flow therein with variable velocity distribution or variable temperature distribution to improve the mixed state or heat conduction efficiency of the fluid.

The third object of the present invention is to provide a tubular body characterized in that the profile of the internal wall of said tubular body in contact with a fluid flowing therein is made various to improve the mixed state or heat conduction efficiency of the fluid.

The fourth object of the present invention is to provide a tubular body which has a series of projecting ribs formed on its internal surface.

The fifth object of the present invention is to provide a tubular body in which a series of projecting ribs formed on its internal surface has waviness with specific periodicity.

The sixth object of the present invention is to provide a tubular body in which said projecting ribs have each a specific depth from the external surface of said tubular body and a specific angle to the axial direction of said tubular body.

Several other objects of the present invention will become apparent from the detail description of preferred embodiments and the attached drawings, in which.

Next, an embodiment of the present invention is to be described referring to the attached drawings.

Figure 1:
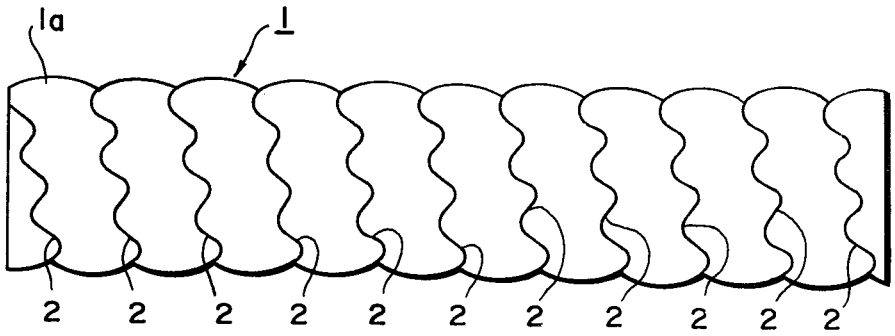
FIG. 1 is a front elevation view of a tubular body according to the present invention.
Figure 3:
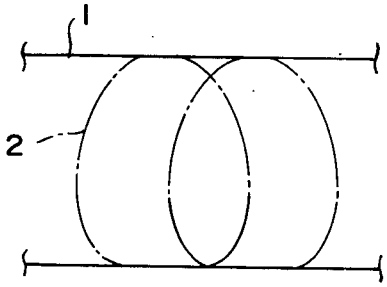
FIGS. 3 and 4 are diagrams illustrating the formation of recesses.
Figure 2:
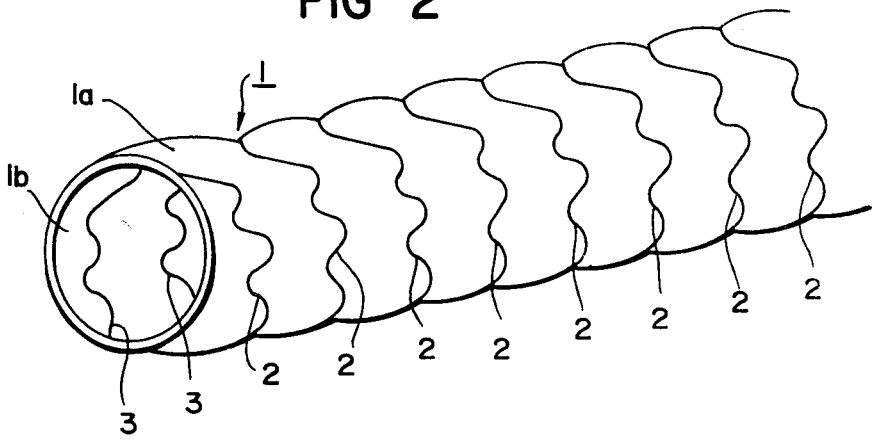
FIG. 2 is an oblique view of a tubular body according to the present invention.
Figure 5A:
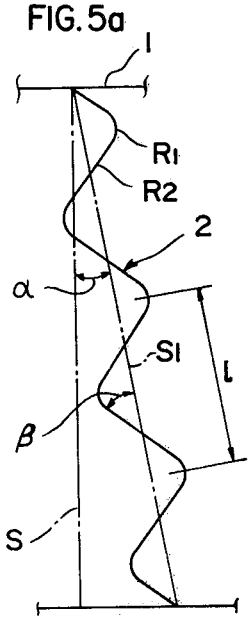
FIG. 5 and 6 are diagrams showing the details of said recesses.
Figure 5B:
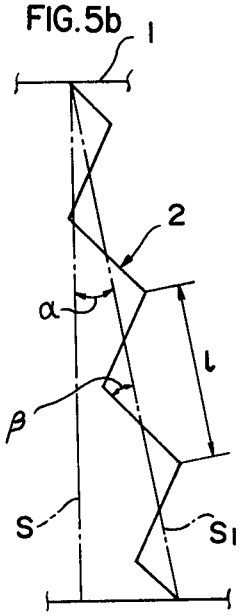
Figure 5C:
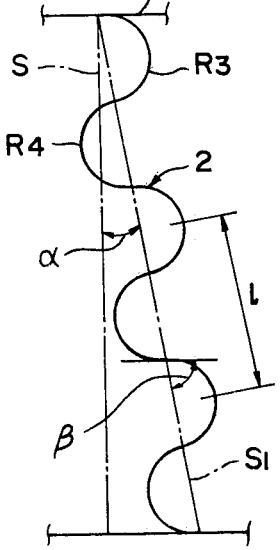
Figure 5D:
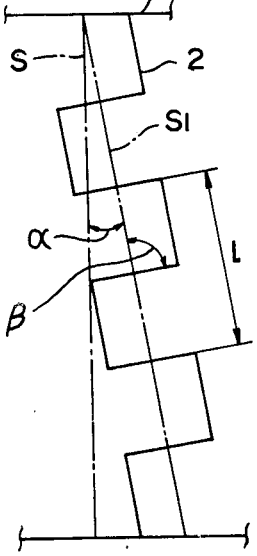
Figure 6:
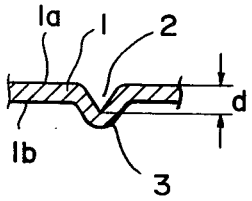

In FIGS. 1, 2 and 3, on the external surface 1a of a tubular body 1 are formed spirally a series of periodically wavy recessed ribs 2 (see FIG. 6) of specific depth and angle and thereby on its internal surface 1b are formed the corresponding series of projecting ribs 3 with waviness of specific periodicity (see FIG. 6).

Figure 4:
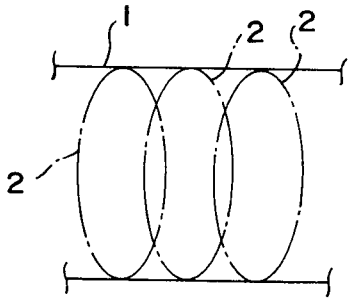

In the embodiment illustrated in FIGS. 1 and 2, said recessed ribs 2 are spirally formed on the external surface 1a of the tubular body 1, but they may be formed in a ring fashion as shown in FIG. 4.

The sectional profile of the tubular body 1 illustrated is circular, but any other profile may be used.

In FIGS. 3 and 4 the recessed rib 2 is indicated by a two dot-chain line.

Now referring to FIGS. 5 and 6, further description is made of said wavy recesses arranged with specific periodicity.

As illustrated in FIG. 5 (*a*) (*b*) (*c*) (*d*), for spiral formation of said recessed ribs 2 on the external surface 1a of the tubular body 1, a base line $S_1$ of said series of recessed ribs 2 with waviness of specific periodicity is imagined with a lead angle $\alpha$. Thereby $\alpha = 1° \sim 30°$.

For ring formation of said recessed ribs 2 on the external surface 1a of the tubular body 1, the contact angle formed between said base line $S_1$ of the series of periodically wavy recessed ribs 2 and the cross section S of the tubular body 1 (cross-sectioned along an axis vertical to the longitudinal axis of the tubular body 1), is taken as $\alpha$,$\alpha$ being in the range of $1° \sim 30°$.

In the above description the lead angle $\alpha$ or the contact angle $\alpha$ is set in the range of $1° \sim 30°$ which is the most desirable, but this range is not the only one available.

As indicated in FIG. 6, the depth d of said recessed rib 2 is set in the range of $0.5 \sim 5$ mm, which is the most desirable, but this range is not the only one available.

In FIG. 5 (*a*), the waviness is a continuation of circular part $R_1$ and straight part $R_2$; and a series of recessed ribs 2 with such a waviness are formed on the tubular body 1. In this case the period l of a waveform is set in the range of $3.5 \sim 50$ mm and the angle of intersection $\beta$ between the straight part $R_2$ and the base line $S_1$ is set in the range of $5° \sim 60°$. In FIG. 5(*a*) the waveform is a continuation of the circular part $R_1$ and the straight part $R_2$, but this is not the only form available; it may be a sine wave of Sin $\beta$ or a cosine wave of Cos $\beta$, the angle $\beta$ thereby being set in the range of $5° \sim 60°$ and the period l from crest to crest of wave set in the range of $3.5 \sim 50$ mm.

In FIG. 5(*b*) the waveform is saw-tooth and a series of such saw-tooth recessed ribs 2 are formed with a period l on the tubular body 1, the period l thereby being in the range of $3.5 \sim 50$ mm and the angle $\beta$ between the saw-tooth wave and the base line $S_1$ being in the range of $5° \sim 60°$.

The ranges set in FIG. 5 (*a*) (*b*), i.e., $\beta = 5° \sim 60°$ and $l = 3.5 \sim 50$ mm are the most desirable, but they are not the only ranges available.

In FIG. 5(*c*) the waveform is an alternate succession of the semi-circular part $R_3$ and its inversion $R_4$ and a series of recessed ribs 2 with such a waveform are formed on the tubular body 1, the crest-to-crest period l being set in the range of 3.5~50 mm and the angle $\beta$ of intersection between the base line $S_1$ and the transition line $S_3$ from the circular part $R_3$ to the circular part $R_4$ being set in the range of 1°~90°.

In FIG. 5(*d*), the waveform is square and a series of recessed ribs 2 with such a square waveform are formed on the tubular body, l thereby being in the range of 3.5~50 mm and the angle $\beta$ of intersection between the square waveform and the base line $S_1$ being in the range of 1°~90°.

The ranges set in FIG. 5 (*c*) (*d*), i.e., $\beta$=1°~90° and l=3.5~50 mm are the most desirable, but they are not the only ones available. And other waveforms than illustrated in FIG. 5 can be used.

The results of experiments using a tubular body according to the present invention are described below.

In the experiments the tubular body 1 was externally heated to a specific temperature under a specific rate of air flow; a fluid with a specific temperature was passed through the tubular body 1; and the temperature of the fluid near the exit of the tubular body 1 was measured, thereby comparing the invented tubular body with the conventional one.

Experiment A

| Air flow in tube | Average exit temperature of fluid for entrance temperature 20° C. Kind: Conventional | Invented |
|---|---|---|
| 38 $NM^3$/Ho | 56.29° C. | 81.47° C. |
| 27 $NM^3$/Ho | 64.24° C. | 97.82° C. |
| 18 $NM^3$/Ho | 76.0° C. | 118.15° C. |
| 10 $NM^3$/Ho | 93.12° C. | 146.06° C. |

In this experiment the heat conduction area was the same for both tubular bodies and the outside temperature of heating was 280° C.

Experiment B

| Air flow in tube | Average exit temperature of fluid for entrance temperature 18° C. Kind: Conventional | Invented |
|---|---|---|
| 41 $NM^3$/Ho | 32.32° C. | 43.06° C. |
| 28 $NM^3$/Ho | 36.32° C. | 49.47° C. |
| 17 $NM^3$/Ho | 44.82° C. | 62.82° C. |
| 10 $NM^3$/Ho | 51.76° C. | 76.59° C. |

In this experiment the heat conduction area was set at ½ of that in experiment A and the heating temperature was lowered to 200° C.

In experiment A the average exit temperature in the invented tubular body turned out 1.5~1.6 times that in the conventional one, and in experiment B it was 1.3~1.5 times. The result has testified to an improvement of the heat conduction effect in the tubular body 1 according to the present invention.

An example of the tubular body 1 of the present invention being applied as the heat conduction pipe of a heat exchanger is to be described here.

Figure 7:
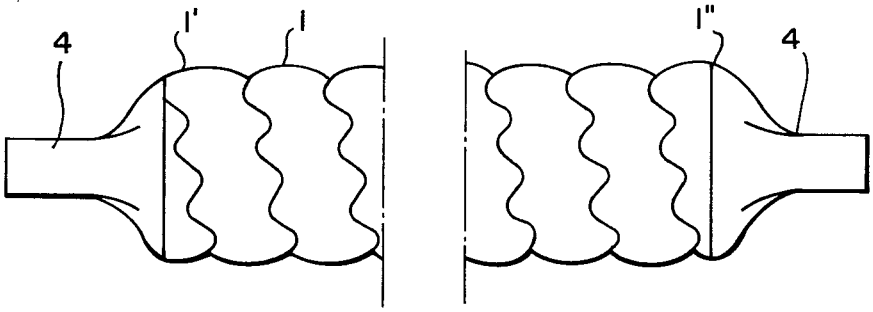
FIG. 7 is a front elevation view illustrating a tubular body according to the present invention applied as the heat conduction pipe of a heat exchanger.
Figure 8:
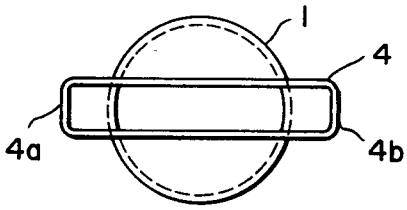
FIG. 8 is a side view corresponding to FIG. 7.

In FIGS. 7 and 8, the two ends 1', 1'' of the tubular body 1 are flattened to form a junction 4 which is rectangular in cross section and the two sides 4*a*, 4*b* of said junction 4 are equally bulged outward.

Figure 9:
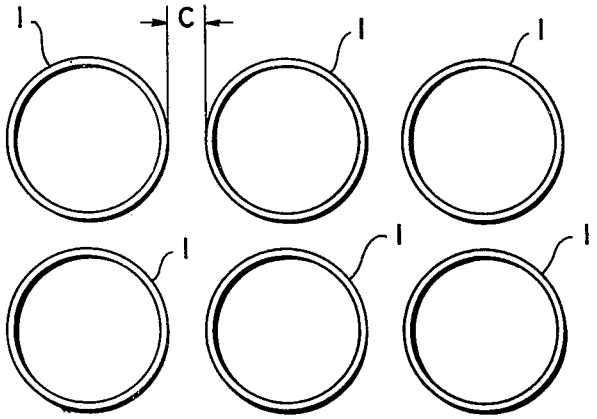
FIG. 9 is an elevation view showing an array of tubular bodies of FIG. 7.
Figure 10:
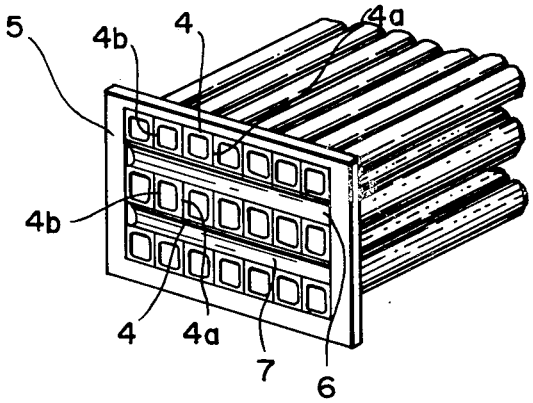
FIG. 10 is an oblique view of an assembly of tubular bodies of FIG. 7.

As illustrated in FIGS. 9 and 10 numerous tubular bodies 1 are arranged in parallel to form a grid (the arrangement is not limited to this one); and with all tubular bodies assembled at the ends 1',1'' the sides of adjacent bodies are welded together transversely 4*a* to 4*a*, 4*b* to 4*b* as well as longitudinally 4*a* to 4*b*. Thereby the gap C between the adjacent bodies is adjustable by changing the amount of bulge at 4*a*, 4*b* and thus the flow rate of a fluid passing through the gap C can be increased by appropriately setting the bulge or transverse extension of sides 4*a*, 4*b*.

The junctions 4 of assembled tubular bodies 1 are fitted in a framework 5, which sets the positions of these tubular bodies. Then elastically deformable sleeves 6, 7 are inserted into the space formed between the junctions 4 of tubular bodies 1 positioned in the longitudinal direction. Thereby the thermal strain caused in the vertical direction (in FIG. 10) of the junctions 4 by thermal expansion can be absorbed by the deformation of the sleeves 6, 7, while the thermal strain in the transverse direction of the junctions due to welding can be offset by the thermal strain of the framework 5 fabricated of the same material as the tubular body 1. Meanwhile the thermal strain in the longitudinal direction of the tubular body 1 can be absorbed by the gap C (FIG. 9) between adjacent tubular bodies 1. In this example the junction 4 is formed by flattening the ends 1', 1'' of the tubular body 1, but it may be formed by enlarging these ends (FIG. 7).

Such being the constitution, the present invention makes the flow velocity and temperature distributions inside and outside of the tubular body variable, thereby improving the heat conduction effect or the mixing effect of a fluid flowing in the tubular body.

What is claimed is:

1. A tubular body comprising:

a series of periodically wavy recessed ribs formed on the external surface of the tubular body, said recessed ribs having a specific depth and a specific angle and a specific wave form about a base line at a center of the wave form, plural base lines being formed as rings at a specific angle to a plane perpendicular to a longitudinal axis of the tubular body; and a corresponding series of projecting ribs having the same specific wave form about the same base line formed on the internal surface of the tubular body, the specific wave form being selected from a group of wave forms consisting of a sinusoid wave form, a saw tooth wave form, a wave form made on continuously connected alternating opposite semicircular curves, and a rectangular wave form.

2. A tubular body of claim 1, wherein the base line of said recessed ribs and projecting ribs are, most desirably, spirally set in the range of lead angles 1°~30°.

3. A tubular body of claim 1, wherein the depth of said recessed ribs is most desirably set at 0.5~5 mm.

4. A tubular body of claim 1, wherein said recessed rib is formed as an alternate continuation of circular part and straight part.

5. A tubular body of claim 4, wherein the period of the waveform of said recessed ribs is most desirably set at 3.5~50 mm.

6. A tubular body of claim 4, wherein the angle of intersection between the base line of said recessed rib and said straight part is most desirably set at 5°~60°.

7. A tubular body of claim 1, wherein said recessed rib is a sine wave of Sin $\beta$.

8. A tubular body of claim 1, wherein the value of $\beta$ is most desirably set at 5°~60°.

9. A tubular body of claim 1, wherein said recessed rib is a cosine wave of Cos $\beta$.

10. A tubular body of claim 9, wherein the value of $\beta$ is most desirably set at $5° \sim 60°$.

11. A tubular body of claim 1, wherein said recessed rib is a saw-tooth wave.

12. A tubular body of claim 11, wherein the period of said saw-tooth wave is most desirably set at $3.5 \sim 50$ mm.

13. A tubular body of claim 11, wherein the angle of intersection between the base line of said recessed rib and said saw-tooth wave is most desirably set at $5° \sim 60°$.

14. A tubular body of claim 1, wherein said recessed rib is formed as an alternate continuation of semi-circular part and its inversion.

15. A tubular body of claim 14, wherein the period of the waveform of said recessed rib is most desirably set at $3.5 \sim 50$ mm.

16. A tubular body of claim 14, wherein the angle between the base line of recessed rib and the transition line from said circular part to its inversion is most desirably set at $1° \sim 90°$.

17. A tubular body of claim 1, wherein said recessed rib is a square wave.

18. A tubular body of claim 17, wherein the period of said square wave is most desirably set at $3.5 \sim 50$ mm.

19. A tubular body of claim 17, wherein the angle of intersection between the base line of recessed rib and said square wave is most desirably set at $1° \sim 90°$.

20. A heat exchanger comprising a plurality of tubular bodies of claim 1 having aligned axes and adjacent ends, and having framework means holding the adjacent ends.

21. A tubular body comprising:

a series of periodically wavy recessed ribs formed on the external surface of the tubular body, said recessed ribs having a specific depth and a specific angle and a specific wave form about a base line at a center of the wave form, the base line being of a ring fashion formed at a specific angle to a plane perpendicular to a longitudinal axis of the tubular body; and a corresponding series of projecting ribs having the same specific wave form about the same base line formed on the internal surface of the tubular body, the specific wave form being selected from a group of wave forms consisting of sinusoid wave form, a saw tooth wave form, a wave form made of continuously connected alternating opposite semicircular curves, and a rectangular wave form.

22. A tubular body of claim 21, wherein the basic line of recessed ribs and projecting ribs are of a ring fashion.

23. A tubular body of claim 22, wherein the ring fashion of said baseline is desirably cut at a specific angle $1° \sim 30°$ from a line perpendicular to the longitudinal axis of the tubular body.

* * * * *